United States Patent [19]

Kato et al.

[11] 4,350,409

[45] Sep. 21, 1982

[54] CONNECTOR KEYING DEVICE

[75] Inventors: Matsuo Kato; Tomonari Ohtsuki; Yoshiaki Igarashi; Tsukasa Saito; Toshiaki Suzuki, all of Mooka, Japan

[73] Assignee: Bunker Ramo Corporation, Oak Brook, Ill.

[21] Appl. No.: 248,799

[22] Filed: Mar. 30, 1981

Related U.S. Application Data

[63] Continuation of Ser. No. 81,307, Oct. 2, 1979, abandoned.

[30] Foreign Application Priority Data

Oct. 5, 1978 [JP] Japan ..... 53-136098[U]

[51] Int. Cl.[3] ..... H01R 13/645

[52] U.S. Cl. ..... 339/186 M; 339/176 MP

[58] Field of Search ..... 339/184 R, 184 M, 186 R, 339/186 M, 176 MP

[56] References Cited

U.S. PATENT DOCUMENTS

| | | | |
|---|---|---|---|
| 3,675,185 | 7/1972 | Ruehlemann et al. | 339/186 M |
| 4,159,862 | 7/1979 | Funck et al. | 339/186 M |

FOREIGN PATENT DOCUMENTS

| | | | |
|---|---|---|---|
| 2021547 | 11/1971 | France | 339/186 M |
| 2532885 | 12/1976 | France | 339/186 R |
| 586962 | 4/1977 | Switzerland | 339/186 R |
| 832658 | 4/1960 | United Kingdom | 339/184 R |

*Primary Examiner*—John McQuade

*Attorney, Agent, or Firm*—F. M. Arbuckle; N. A. Camasto

[57] ABSTRACT

This invention relates to the field of electrical connectors, and particularly concerns electrical connectors with multiple contacts requiring keying of the mating connector parts. With prior art devices, when more than one connector pair is used in a system, different connector parts must be chosen which have a different keying configuration for the key and groove. With another prior art device, which uses a single type connector part, it is necessary to sacrifice one contact position in the connectors. The present invention overcomes the deficiencies of the prior art noted above by providing a keying device which permits manufacture and production of a single type of male or female connector part and yet does not require the sacrifice of contact positions within the connector parts to effectuate the keying. The invention therefore provides an improved connector keying device for keying mating first and second connector parts to assure proper connection between the parts and to prevent connection to other connector parts of unlike keying. In accordance with the invention, there is provided a key mount affixed to the first connector part and adapted to receive a key member mounted thereto. An appropriate key member is removably attached to the key mount. A key member receiver is mounted on the second connector part and has a key member-receiving slot therein aligned with and slidingly receiving the key member when the first and second connector parts are mated.

13 Claims, 11 Drawing Figures

Fig. 4
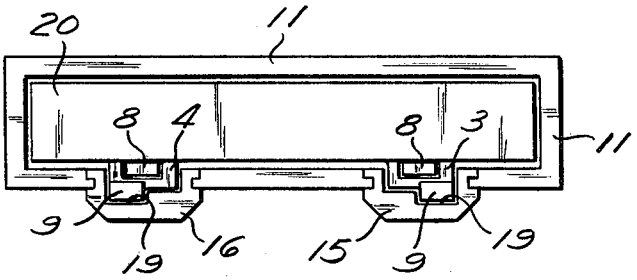
Fig. 5
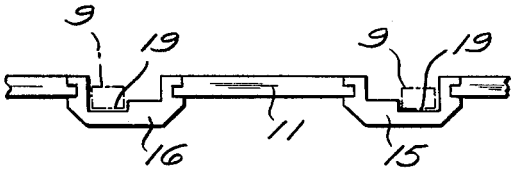
Fig. 6
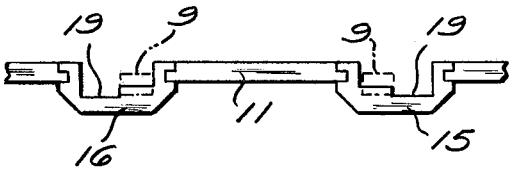
Fig. 7
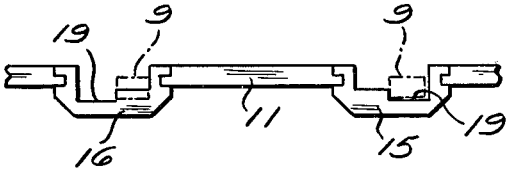
Fig. 8
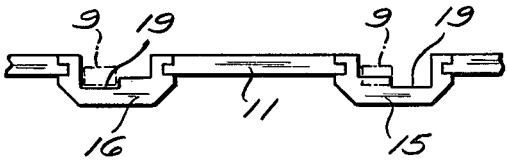
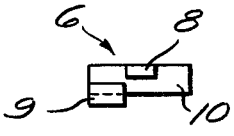
Fig. 9
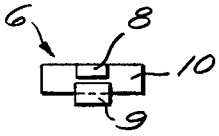
Fig. 10
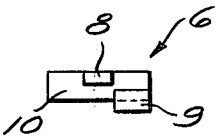
Fig. 11

CONNECTOR KEYING DEVICE

This is a continuation application of application Ser. No. 06/081,307, filed Oct. 2, 1979, now abandoned.

TECHNICAL FIELD

This invention relates to the field of electrical connectors, and particularly concerns electrical connectors with multiple contacts requiring keying of the mating connector parts.

BACKGROUND OF THE PRIOR ART

Connector keying is an old art, and many forms of keying devices have been used in the past.

The need for keying electrical connectors has been long understood. Especially with multiple-contact electrical connectors, it is often necessary to prevent connecting two electrical connectors together, e.g., when in the wrong orientation or when connection to the wrong mating connector is to be avoided. Many electronic devices today utilize connectors in which the contacts are equally spaced along straight rows and are symmetrical relative to a center line of the connector. Should the plug and receptacle be reversed and coupled together, electrical connections will be made between the two connector parts, which could have catastrophic results.

Furthermore, because of intentionally imposed limitations on the number of contacts of a multi-contact connector, an electronic apparatus may be assembled with several multi-contact connectors to mate with corresponding connectors, which may be chassis mounted or printed circuit board-mounted. In these apparatuses, if the connectors are all of the same type, i.e., same number of contacts and same physical shape, the connector parts can be mistakenly inserted onto a mating connector adjacent the one intended to be connected due to the usual allowance for slack in the wiring. In other words, it is not possible under certain circumstances to prevent malfunctions due to misconnection merely by limiting the length of wire leading to the free connector part or parts.

In the prior art, one device which has been used to avoid the problems discussed above has a raised key on the outer surface of one connector part and a mating groove aligned with the key in the other connector part, with the key nesting in the groove when the connectors are properly connected. However, when more than one connector pair is used in a system, different connector parts must be chosen which have a different keying configuration of key and groove. This type of keying requires a variety of differently keyed connectors and consequently results in parts control and logistics problems. This solution to the problem is also uneconomical, involving higher costs due to the necessity of preparing many sets of expensive molds for making the connector parts.

Another prior art solution to the above-noted problem involves one of the series of female contacts of the female connector part and cutting off the male contact of the male connector part corresponding to the plugged female contact. Thus there is only one orientation of connector parts that is possible for mating, namely with the plugged female contact aligned with the cut-off male contact. Reverse orientation and incorrect selection of mating connector parts is therefore avoided. The advantage that these types of devices have over the aforementioned device is that all connector parts share a common mold. On the other hand, it is necessary to sacrifice one contact position and labor costs also increase, the contact loss can also be very disadvantageous when there is limited space within the apparatus for installing and connecting the connectors.

BRIEF SUMMARY OF THE INVENTION

The present invention overcomes the deficiencies of the prior art noted above by providing a keying arrangement which permits manufacture of a single type of male or female connector part and yet does not require the sacrifice of contact positions. The invention therefore provides an improved connector keying arrangement for keying mating first and second connector parts to assure proper connection between the parts and to prevent connection to other connector parts of unlike keying.

In accordance with the invention, there is provided a key mount affixed to the first connector part and adapted to retain an appropriate key member. A key member receiver is affixed to the second connector part and has a key member-receiving slot therein aligned with for slidingly receiving the key member when the first and second connector parts are mated.

In the described embodiment of the invention, the key mount is a generally U-shaped protrusion on one face of the first connector part which defines a key member mounting passageway between the interior of the protrusion and the one face of the first connector. The passageway thus defined extends in the direction of connection of the first and second connector parts.

The key member may include a base, a key projecting from the base, and a mounting leg projecting from the base parallel to the key. The mounting leg is sized to snugly fit into the passageway, while the key lies against an exterior surface of the U-shaped protrusion.

The key member-receiving slot in the described preferred embodiment is preferably defined by a relatively wide key mount slot conformed and sized to receive the U-shaped key mount. A relatively narrow key slot is recessed into the key mount slot and is conformed and sized to receive the key.

The key member is positioned on the key mount by inserting the mounting leg into the passageway in the key mount until the base of the key member butts against one side of the key mount. A hook-shaped key latch is positioned at the free end of the key and snap-fits over the other end of the key mount to rigidly capture the key mount between the base and the latch.

The key receiver is removably insertable in the second connector part by means of channel members on the edges of the key receiver mating with elongated projections on either side of an opening in the body of the second connector part. In this manner, both the key member and key receiver are removable and selectably mountable on the first and second connector parts, respectively. Thus, the connector parts are of standard configuration with standard key mounts and key receiver openings, respectively and keying is accomplished by different configurations of key member and key receiver. Thus, a variety of keying combinations can be realized by utilizing a set of differently configured key members and key receivers without requiring changes in the main body of the connector parts.

The number of keying devices per connector and the number of positions of the key on each key member (and corresponding key slot on each key receiver) determine the number of possible keying combinations.

BRIEF DESCRIPTION OF THE DRAWINGS

The invention will now be described in detail with reference to the accompanying drawings representing preferred embodiments of the connector keying arrangement according to the present invention. In the drawings:

FIG. 4 is a downward looking view of the mated connector parts of FIG. 3 (excluding the cable);

FIGS. 5–8 show a partial cross sectional view of the front wall of the connector arrangement of FIG. 4 and illustrates various keying positions for the key and key slot;

FIGS. 9–11 show a top plan view of three different key members making up a part of the present invention, each of the three key members having a different keying location for the key relative to the base upon which it mounts.

DETAILED DESCRIPTION OF THE INVENTION

Figure 1:
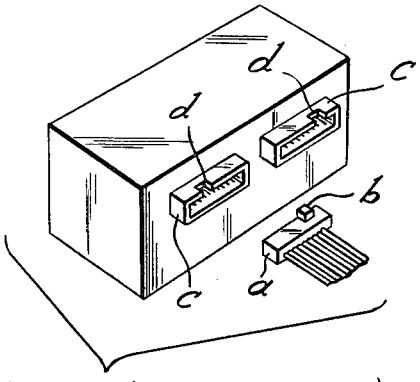
Fig. 1 (PRIOR ART)
FIGS. 1 and 2 are perspective views of two different types of prior art connector keying arrangements.

FIG. 1 shows a typical prior art keying system whereby two first connector parts c are mounted in a chassis and have differently located keying grooves d in the top surface of the connector part. A second connector part a has a key b projecting from its upper surface, and it is clear that the second connector part a can only be plugged into the right chassis-mounted connector part c when key b fits into groove d. As explained earlier, this arrangement is disadvantageous from the viewpoint that a different connector part is required for each different keying configuration.

Figure 2:
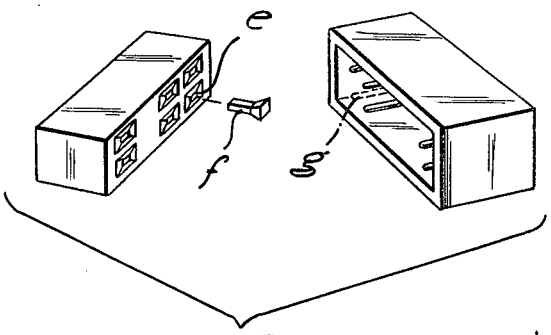
Fig. 2 (PRIOR ART)

FIG. 2 illustrates a known improvement over the prior art of FIG. 1, but suffers the disadvantages described above in connection with utilizing a plug f inserted into a female contact e at a location corresponding to the missing male pin g of the other connector part. As can be observed, this method requires the sacrifice of one complete male/female contact connection within the connector and entails added labor costs.

Figure 3:
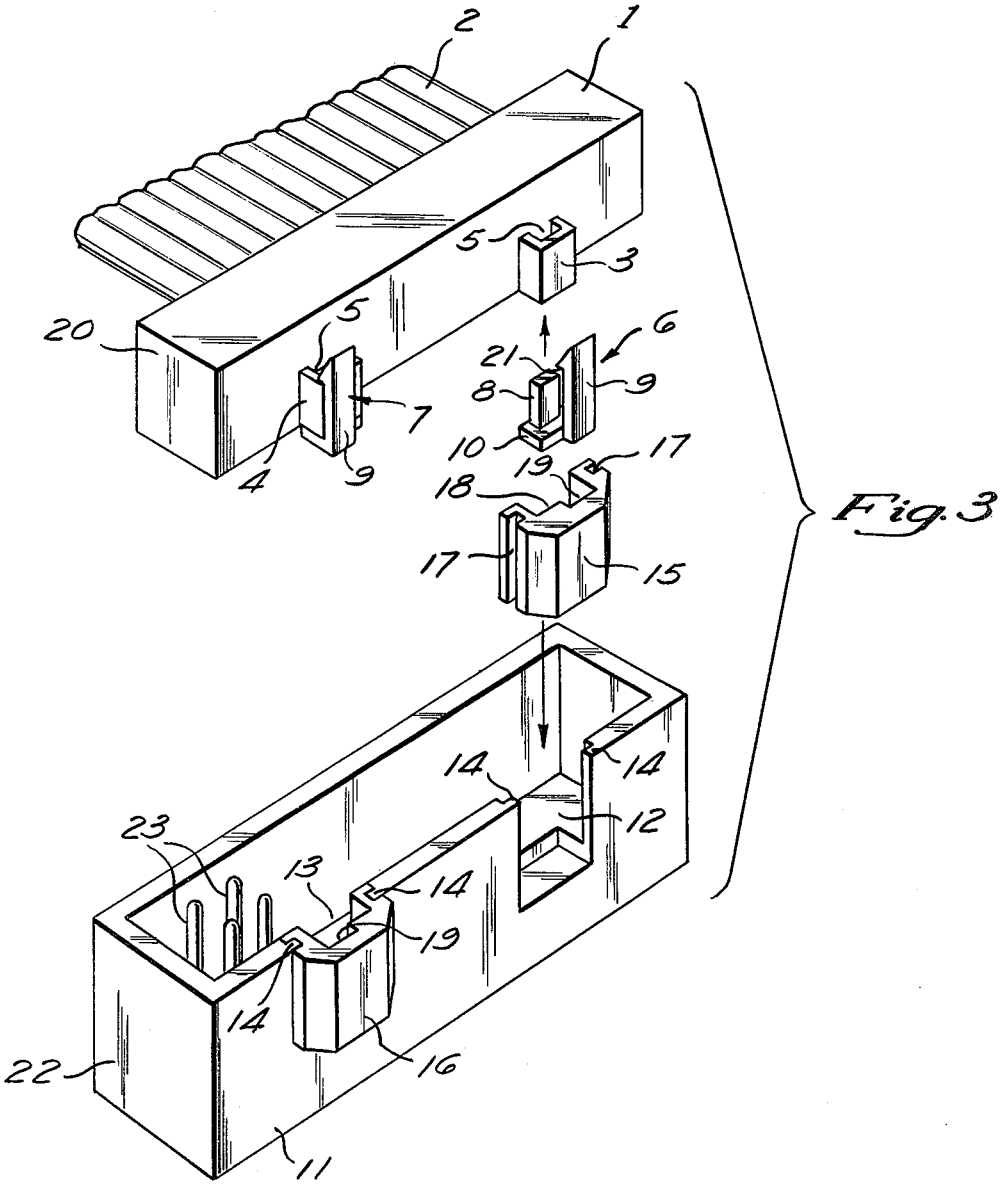
FIG. 3 is a perspective exploded view of a connector keying arrangement according to the present invention arrangement.

In the exploded perspective view of FIG. 3, the basic elements of the preferred embodiment of this invention can be seen. A female connector part 1 has a multi-wire flat cable 2 for making connection to female contacts (not shown) accessible at the bottom of the connector part.

U-shaped key mounts 3 and 4 are positioned along the front face of main body 20 of female connector part 1. The opening between the interior of key mounts 3 and 4 and body 20 define key member mounting passageways 5 for receiving mounting legs 8 of key members 6 and 7.

The key member 6 (and 7) has three parts, a base 10, a projecting mounting leg 8, and a key 9 extending parallel to mounting leg 8 on the opposite side of base 10. A hook-shaped latch 21 is located at the free end of key 9, and the spacing between the top surface of base 10 and the lateral surface of latch 21 corresponds to the distance between the end faces of key mounts 3 and 4. With this arrangement, when mounting leg 8 is inserted into passageway 5, the resilience of key 9 permits latch 21 to deflect and snap over the top edge of key mount 3. The snug fit of mounting leg 8 in passageway 5 and the latching of the key 9 holds key member 6 in firmly on key mount 3. In the top part of FIG. 3, a pair of key mounts 3 and 4 are shown with key member 6 ready for mounting on key mount 3 and a different key member 7 firmly mounted on key mount 4.

In the lower portion of FIG. 3, a male connector part 11 having a main body 22 supports a plurality of male contacts 23 for mating with the female contacts of the female connector part 1. Openings 12 and 13 are provided in one side of body 22 to serve as mounting means for the key receivers 15 and 16. Key receiver 15 has a wide key mount slot 18 with a deeper and narrower key slot 19 adapted to receive the key mount 3 and key 9, respectively. The key receiver 15 is mountable on body 22 by the provision of a pair of channels 17 on either side of the receiver 15 which engage corresponding longitudinal projections 14 along the side edges of opening 12 in an interference fit.

Key member 6 has its key 9 positioned to the right while key member 7 has its key 9 positioned to the left. Likewise, in the key receivers 15 and 16, the key slots 19 are positioned accordingly, i.e., to be aligned with keys 9 of key members 6 and 7, respectively, when the two connector parts 1 and 11 are mated.

It will be appreciated that, rather than supply a different key member 7 and key receiver 16, due to the symmetry of key mounts 3 and 4 as well as openings 12 and 13, a second key member 6 could be inserted in an inverted position in key mount 4, and a second key receiver 15 could be likewise inverted and inserted in opening 13 thus utilizing only a single key member type and a single key receiver type.

Turning now to FIG. 4, a top view of the mated connector parts 1 and 11 is shown. A pair of key mounts 3 and 4 are shown with their keys 9 positioned in key slots 19 in key receivers 15 and 16, respectively.

FIGS. 5 through 8 illustrate a single configuration for the key receivers 15 and 16 and the four possible combinations for locating the keys 9 of key members 6 and 7. In FIG. 5 keys 9 located in their outward position, align with key slots 19, thereby permitting the two connector parts to engage. In FIGS. 6–8, however, any of the three other possible combinations for the locations of keys 9 will cause an obstruction, i.e., at least one of the keys 9 is not aligned with at least one of the key slots 19, and accidental connection or misorientation of the connector is not possible. In FIG. 6, the keys 9 are shown in the inwardmost position, in FIG. 7 both are shown at the extreme right, and in FIG. 8, both are shown at the extreme left.

FIGS. 9, 10 and 11 show an alternate form of the invention wherein the key member 6 (or 7) is shown with a central mounting leg 8 and three different positions for key 9, laterally to the left of leg 8 in FIG. 9, centrally aligned with leg 8 in FIG. 10, and laterally to the right of leg 8 in FIG. 11. Of course, corresponding key receivers would be required to accommodate the three possible configurations of key member, but the number of possible keying combinations would be greatly increased. In particular, for a connector having M keying devices, and wherein each keying device has N possible locations for the key, the number of possible keying combinations is $N^M$. The advantage of using the keying device of the present invention becomes clear when realizing that for this number of keying combinations, a maximum of only $2 \times N$ different inexpensive key members and key receivers would be required, i.e., N different key members and N different key receivers.

In the illustrations of the drawings, the key members have been attached to key mounts on the female connector part 1, while the key receivers 15 and 16 have been shown mounted on male connector part 11. Obviously, the two keying devices on the different connector parts could be reversed.

Thus, it can be appreciated that, while different molds will be required to produce the unique key members and key receivers, only a single kind of male and female connector part will be required to result in a variety of keying combinations for the connectors.

From the foregoing, it can be readily realized that this invention can assume various embodiments. Thus, it is to be understood that the invention is not limited to the specific embodiments described herein, but is to be limited only by the appended claims.

We claim:

1. A connector keying arrangement for keying mating first and second connector parts to assure proper connection between the parts and to prevent connection to other connector parts of unlike keying comprising:

a key mount affixed to the first connector part, said key mount having means for mounting a key member thereto;

a key member removably attached to said key mount;

a key receiver mounted on the second connector part and having a key member-receiving slot therein aligned with and slidingly receiving said key member when the first and second connector parts are mated;

said key mount comprising a generally U-shaped protrusion on one face of the first connector part defining a key member mounting passageway between the interior of said protrusion and said one face, said passageway extending in the direction of connection of said first and second connector parts;

said key member comprising a base, a key projecting from said base, and a mounting leg projecting from said base parallel to said key;

said mounting leg being sized to snugly fit into said passageway, and said key lying against the exterior surface of said U-shaped protrusion.

2. The connector keying arrangement as claimed in claim 1, wherein said key member-receiving slot is defined by a relatively wide key mount slot conformed and sized to receive said U-shaped key mount, and a relatively narrow and deeper key slot conformed and sized to receive said key.

3. The connector keying arrangement as claimed in claim 1, wherein:

said passageway extends completely through said U-shaped protrusion to define end faces on said U-shaped protrusion of U-shaped cross-section; and said key member is mounted on said U-shaped protrusion with said mounting leg in said passageway and said base butted against one of said end faces.

4. The connector keying arrangement as claimed in claim 3, wherein said key includes a hook-shaped key latch at its free end opposite said base, said latch having a lateral face located from said base a distance corresponding to the distance between said end faces of said U-shaped protrusion, thereby effecting a tight and secure mounting of said key member on said key mount with said base pressed against one of said end faces and said lateral face pressed against the other of said end faces.

5. The connector keying arrangement as claimed in claim 3, wherein said key projects from the center of one side of said base.

6. The connector keying arrangement as claimed in claim 3, wherein said key projects from said base laterally displaced along said base relative to said mounting leg.

7. The connector keying arrangement as claimed in claim 2, wherein said key slot is centered at one side of said key receiver.

8. The connector keying arrangement as claimed in claim 2, wherein said key slot is off center of said key receiver.

9. The connector keying arrangement as claimed in claim 6, wherein said key member is mountable on said key mount from either of said end faces.

10. A connector keying arrangement for keying mating first and second connector parts to assure proper connection between the parts and to prevent connection to other connector parts of unlike keying comprising:

a key mount affixed to the first connector part, said key mount having means for mounting a key member thereto;

a key member removably attached to said key mount;

a key receiver mounted on the second connector part and having a key member-receiving slot asymmetrically located therein, aligned with and slidingly rreceiving said key member when the first and second connector parts are mated, said key member-receiving slot being adapted to receive said key member from the front or back of said key receiver;

said key receiver comprising means for removably mounting said key receiver to the second connector part;

the second connector part comprising cooperating means for accommodating said key receiver mounting means;

said means for removably mounting said key receiver and said copperating means comprising a pair of elongated channel means and a pair of elongated projections respectively received therein, one of said pairs being on opposite sides of said key receiver and the other of said pairs being on opposite sides of an opening in one face of said second connector part;

said key receiver being reversibly mountable in said opening with said elongated projection on either side slidably received in said elongated channel means on either side, whereby said asymmetrically located key member-receiving slot is locatable in two different key member-receiving positions, by reverse-mounting said key receiver upon said second connector part, so as to receive two different key member configurations with a single type of key receiver.

11. The connector keying arrangement as claimed in claim 10 wherein:

said key member is asymmetrical;

said key member and key mount are adapted for reversible mounting of said key member upon said first connector part; and said key member when reversed mates with said key receiver;

whereby either one of said two different key member configurations may be achieved by reversing said key member.

12. The connector keying arrangement as claimed in claim 11 wherein said second connector part comprises at least two of said openings for removably and reversibly mounting said key receiver to said second connector part; and duplicates of said key receiver are simultaneously mounted in opposite orientations within said openings respectively;

whereby said two different key member configurations, when located at two corresonding locations on said first connector part, will mate with said duplicate key receivers respectively.

13. The connector keying arrangement as claimed in claim 12 wherein:

said first connector part comprises at least two of said key mounts at said corresponding locations; and duplicates of said key member are simultaneously mounted in opposite orientations on said key mounts respectively;

whereby said two different key member configurations are achieved with said oppositely oriented duplicate key members.

* * * * *